US011192375B2

(12) United States Patent
Sarkinen et al.

(10) Patent No.: US 11,192,375 B2
(45) Date of Patent: Dec. 7, 2021

(54) DROP-ON-DEMAND INK DELIVERY SYSTEMS AND METHODS IN CARD PROCESSING SYSTEMS

(71) Applicant: Entrust Corporation, Shakopee, MN (US)

(72) Inventors: Daniel Sarkinen, Shakopee, MN (US); Brian O'Dell, Shakopee, MN (US); Kyle Johnson, Shakopee, MN (US); Randy Jordan, Shakopee, MN (US)

(73) Assignee: Entrust Corporation, Shakopee, MN (US)

( * ) Notice: Subject to any disclaimer, the term of this patent is extended or adjusted under 35 U.S.C. 154(b) by 0 days.

(21) Appl. No.: 16/531,570

(22) Filed: Aug. 5, 2019

(65) Prior Publication Data

US 2020/0039228 A1 Feb. 6, 2020

Related U.S. Application Data

(60) Provisional application No. 62/715,023, filed on Aug. 6, 2018.

(51) Int. Cl.
*B41J 2/165* (2006.01)
*B41M 5/00* (2006.01)
(Continued)

(52) U.S. Cl.
CPC ..... *B41J 2/16532* (2013.01); *B41J 2/04501* (2013.01); *B41J 2/14* (2013.01); *B41J 2/2107* (2013.01); *B41M 5/0047* (2013.01)

(58) Field of Classification Search
CPC ..... B41J 2/16532; B41J 2/04501; B41J 2/14; B41J 2/2017; B41M 5/0047
See application file for complete search history.

(56) References Cited

U.S. PATENT DOCUMENTS 4,825,054 A 4/1989 Rust et al.
4,995,501 A 2/1991 Lundstrom et al.
(Continued)

FOREIGN PATENT DOCUMENTS

KR 10-2013-0011589 A 1/2013
KR 10-2014-0075118 A 6/2014

OTHER PUBLICATIONS

International Search Report and Written Opinion, International Patent Application No. PCT/IB2019/056659, dated Aug. 5, 2019 (12 pages).
(Continued)

*Primary Examiner* — Thinh H Nguyen
(74) *Attorney, Agent, or Firm* — Hamre, Schumann, Mueller & Larson, PC.

(57) ABSTRACT

DOD ink delivery systems and methods are described herein that are used in DOD card printing systems of card processing systems for supplying ink for DOD printing on plastic cards of the type that bear personalized data unique to the intended cardholder and/or which bear other card information. The DOD ink delivery system is configured to recirculate the ink, or have a second pressure damper container that provides damping to eliminate large and abrupt spikes in ink pressure which can disturb the meniscus of the ink in each nozzle of the print head generated by a vacuum system, or simultaneously operate a supply pump at a lower flow rate than a return pump during an autofill/autodrain procedure on the ink delivery system.

17 Claims, 6 Drawing Sheets

(51) Int. Cl.

| | |
|---|---|
| ***B41J 2/21*** | (2006.01) |
| ***B41J 2/14*** | (2006.01) |
| ***B41J 2/045*** | (2006.01) |

(56) References Cited

U.S. PATENT DOCUMENTS

| | | | | |
|---|---|---|---|---|
| 5,266,781 | A | 11/1993 | Warwick et al. | |
| 5,837,991 | A | 11/1998 | LaManna et al. | |
| 5,980,011 | A * | 11/1999 | Cummins | B41J 2/01 347/101 |
| 6,131,817 | A | 10/2000 | Miller | |
| 6,695,205 | B1 | 2/2004 | Lundstrom et al. | |
| 6,783,067 | B2 | 8/2004 | Kreuter et al. | |
| 6,902,107 | B2 | 6/2005 | Shay et al. | |
| 8,070,248 | B2 | 12/2011 | Ogama et al. | |
| 8,523,336 | B2 * | 9/2013 | Kuribayashi | B41J 2/17596 347/85 |
| 9,523,011 | B2 | 12/2016 | Robello et al. | |
| 10,479,101 | B2 * | 11/2019 | Inada | B41J 2/185 |
| 2002/0001024 | A1 | 1/2002 | Wouters et al. | |
| 2007/0187870 | A1 | 8/2007 | Lundstrom et al. | |
| 2008/0297577 | A1 | 12/2008 | Wouters et al. | |
| 2010/0039486 | A1 | 2/2010 | Wouters et al. | |
| 2011/0285768 | A1 * | 11/2011 | Preckel | B41J 3/40733 347/6 |
| 2013/0169710 | A1 | 7/2013 | Keefe et al. | |
| 2014/0300670 | A1 * | 10/2014 | Tsukamoto | B41J 2/175 347/85 |
| 2018/0272735 | A1 | 9/2018 | Takamura | |
| 2018/0326761 | A1 | 11/2018 | Wooldridge et al. | |
| 2019/0344565 | A1 | 11/2019 | Bontrager et al. | |

OTHER PUBLICATIONS

Atlantic Zeiser, "Persomaster EMV Banking Card Personalization System" brochure, Nov. 2019 (6 pages).

International Search Report and Written Opinion, International Patent Application No. PCT/IB2020/060591, dated Feb. 2, 2021 (13 pages).

* cited by examiner

DROP-ON-DEMAND INK DELIVERY SYSTEMS AND METHODS IN CARD PROCESSING SYSTEMS

FIELD

This disclosure relates to card processing systems that perform drop-on-demand (DOD) printing on plastic cards including, but not limited to, financial (e.g., credit, debit, or the like) cards, driver's licenses, national identification cards, business identification cards, gift cards, and other plastic cards.

BACKGROUND

In DOD printing, ink is ejected from one or more nozzles of a print head by electrically energizing select ones of the nozzles from which the ink is to be ejected. DOD printing on plastic cards in a card processing system presents unique challenges. The printing on the plastic card must be durable and long-lasting, as well as being of very high quality. In addition, the printing can vary from monochromatic using a single color to multi-color using multiple colors such as cyan, magenta, yellow, black and white ink. Further, the card throughput (i.e. the number of cards printed per unit of time) is an important factor in a card processing system that employs DOD printing and efforts are made to maximize the card throughput. Moreover, the printing that occurs on the plastic cards can and often does vary from card to card.

SUMMARY

DOD ink delivery systems and methods are described herein that are used in DOD card printing systems of card processing systems for supplying ink for DOD printing on plastic cards of the type that bear personalized data unique to the intended cardholder and/or which bear other card information. Examples of plastic cards can include, but are not limited to, financial (e.g., credit, debit, or the like) cards, driver's licenses, national identification cards, business identification cards, gift cards, and other plastic cards.

The card processing systems described herein can be any card processing systems that can process plastic cards by printing on the cards using a DOD card printing system having one or more DOD print heads, for example piezoelectric print heads, in combination with one or more of: reading data from and/or writing data to a magnetic stripe on the cards, programming an integrated circuit chip on the cards, emboss characters on the cards, indenting characters on the cards, laminating the cards, using a laser that performs laser processing such as laser marking on the cards, applying a topcoat to a portion of or the entire surface of the cards, checking the quality of personalization/processing applied to the cards, applying a security feature such as a holographic foil patch to the cards, and other card processing operations.

The DOD card printing system used in the card processing system can have a single DOD print head or a plurality of DOD print heads. The DOD print heads can be piezoelectric print heads. The DOD card printing system can perform monochromatic or multi-color printing. In one example of multi-color printing, five DOD print heads, each of which has a plurality of nozzles, can be provided. Each print head can be designated to print a specific color ink, such as cyan, magenta, yellow, black and white (CMYKW). The DOD card printing system can print using any suitable ink (or other material) used in DOD printing and that is suitable for use on the types of plastic cards described herein. For example, the ink can be an ultraviolet (UV) radiation curable ink.

In one embodiment described herein, the DOD ink delivery system is configured to recirculate the ink. Recirculation is useful for inks that need to be recirculated to improve the resulting performance of the ink when applied to a plastic card. The ink could be an ink with a particulate material in the ink, with the recirculation keeping the particulate adequately dispersed in the ink. Examples of inks with a particulate material include, but are not limited to, white ink and what in the card printing industry are referred to as spot colors that include metallic (e.g. gold, silver, etc.) inks. The ink could also be an ink (with or without particulate material, and possibly either a spot color or not a spot color) that is recirculated in order to remove gas from the ink.

In another embodiment described herein, the DOD ink delivery system is configured to provide damping to eliminate large and abrupt spikes in ink pressure which can disturb the meniscus of the ink in each nozzle of the print head generated by a vacuum system. The ink delivery system includes a second volume of dampening that can be provided downstream of the isolation valve of the vacuum system which includes a first volume of dampening. The DOD card printing system sees both volumes of dampening under normal operating conditions when the isolation valve is opened, but sees only the second volume of dampening when the isolation valve is closed.

In another embodiment described herein, the DOD card printing system is configured to perform an autofill/autodrain procedure on the ink delivery system. A supply pump is provided that is fluidly connected to the inlet of the DOD print head, and a separate pump is provided that is fluidly connected to the outlet of the DOD print head. When doing either an autofill or an autodrain on the ink delivery system, the pump connected to the inlet is run so that it has a lower flow rate than the pump connected to the outlet whereby the flow rate at the outlet of the print head is greater than the flow rate at the inlet of the print head.

DRAWINGS

DETAILED DESCRIPTION

Figure 1:
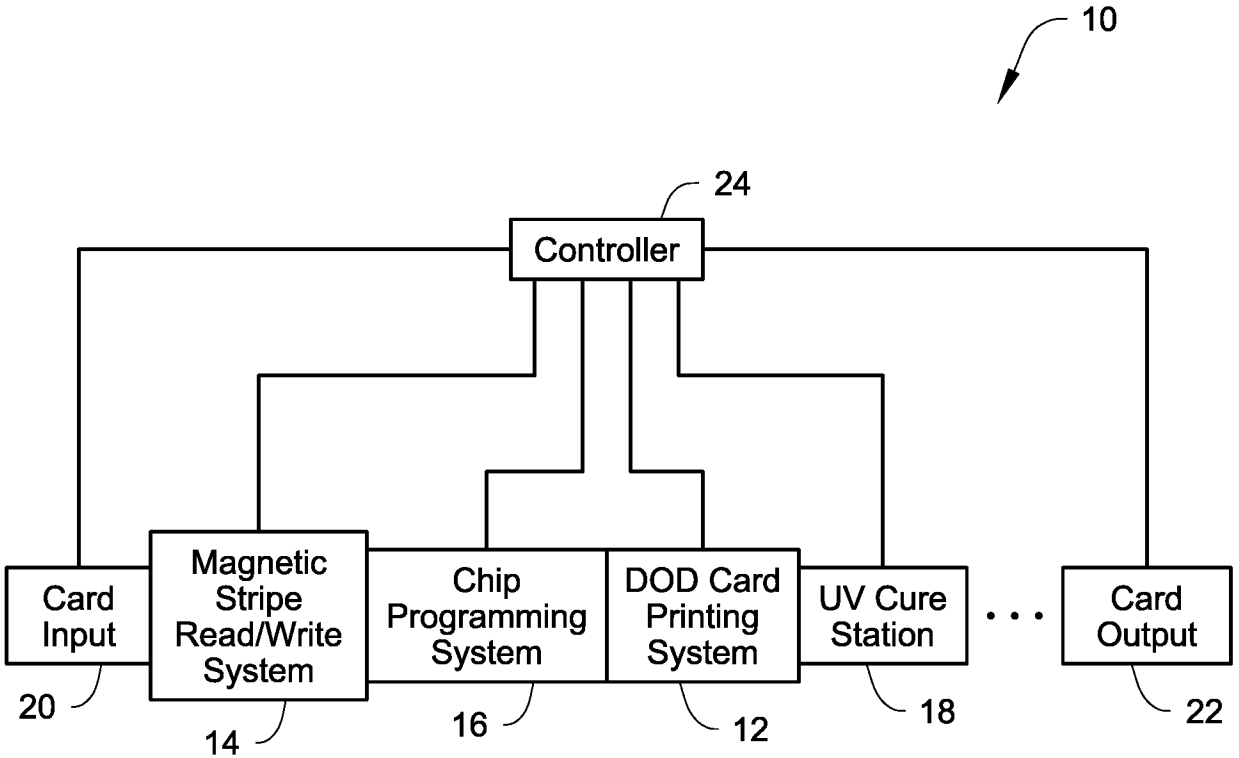
FIG. 1 illustrates an embodiment of a card processing system described herein.

FIG. 1 illustrates an example of a card processing system 10 with which the DOD card printing systems described herein can be used. The DOD card printing systems may alternatively be referred to as DOD printing systems. The system 10 is configured to process cards by at least printing on the cards using at least one DOD card printing system 12 included in the system 10. The system 10 can also include at least one other card processing capability in addition to the printing by the DOD card printing system 12. For example, the additional card processing can include a magnetic stripe read/write system 14 that is configured to read data from and/or write data to a magnetic stripe on the cards, and/or an integrated circuit chip programming system 16 that is configured to program an integrated circuit chip on the cards. When the DOD card printing system 12 prints using ultraviolet (UV) curable ink, a UV cure station 18 can also be provided. The construction and operation of the systems 14, 16, 18 is well known in the art. Magnetic stripe read/write systems and integrated circuit chip programming systems are disclosed, for example, in U.S. Pat. Nos. 6,902,107 and 6,695,205, and can be found in the MX family of central issuance systems available from Entrust Datacard Corporation of Shakopee, Minn. An example of a UV radiation applicator in a card printing system is the Persomaster card personalization system available from Atlantic Zeiser GmbH of Emmingen, Germany.

The cards to be processed within the card processing system 10 include, but are not limited to, plastic cards which bear personalized data unique to the intended cardholder and/or which bear other card information. Examples of plastic cards can include, but are not limited to, financial (e.g., credit, debit, or the like) cards, driver's licenses, national identification cards, business identification cards, gift cards, and other plastic cards.

In some embodiments, the DOD card printing systems 12 described herein can be used to print on substrates other than plastic cards, such as paper substrates, in which case the DOD card printing systems 12 can be referred to as DOD printing systems.

In the system 10 illustrated in FIG. 1, a card input 20 is provided that is configured to hold a plurality of cards waiting to be processed. Cards are fed one-by-one from the card input 20 into the rest of the system 10 where each card is individually processed. Processed cards are ultimately transported into a card output 22 that is configured to hold a plurality of the processed cards.

Operation of the various systems 12, 14, 16, 18, 20, 22 is controlled by one or more controllers 24. Alternatively, each one of the system 12, 14, 16, 18, 20, 22, or select ones of the systems 12, 14, 16, 18, 20, 22 can have its own dedicated controller.

The cards can be transported through the card processing system 10 using any suitable mechanical card transport mechanism(s) that are well known in the art of card handling within card processing systems 10. Examples of card transport mechanisms that could be used are known in the art and include, but are not limited to, transport rollers, transport belts (with tabs and/or without tabs), vacuum transport mechanisms, transport carriages, and the like and combinations thereof. Card transport mechanisms are well known in the art including those disclosed in U.S. Pat. Nos. 6,902,107, 5,837,991, 6,131,817, and 4,995,501 and U.S. Published Application No. 2007/0187870, each of which is incorporated herein by reference in its entirety. A person of ordinary skill in the art would readily understand the type(s) of card transport mechanisms that could be used, as well as the construction and operation of such card transport mechanisms.

The card processing system 10 illustrated in FIG. 1 is a type of system that can be referred to as a central issuance card processing system. In a central issuance card processing system, the card input 20 and the card output 22 are generally at opposite ends of the system 10 with the card processing mechanisms, such as the systems 12, 14, 16, 18 in FIG. 1, between the card input 20 and the card output 22. A central issuance card processing system is typically designed for large volume batch processing of cards, often employing multiple processing stations or modules to process multiple cards at the same time to reduce the overall per card processing time. Examples of central issuance card processing systems include the MX family of central issuance systems available from Entrust Datacard Corporation of Shakopee, Minn. Other examples of central issuance systems are disclosed in U.S. Pat. Nos. 4,825,054, 5,266,781, 6,783,067, and 6,902,107, all of which are incorporated herein by reference in their entirety. In one example, the card processing system 10 (and the systems 12, 14, 16, 18 therein) can process cards at a rate of at least about 500 cards per hour, or at least about 1000 cards per hour, or at least about 1500 cards per hour, or at least about 2000 cards per hour, or at least about 2500 cards per hour, or at least about 3500 cards per hour.

In FIG. 1, the systems 12, 14, 16, 18 can be described as being downstream of the card input 20 and described as being between the card input 20 and the card output 22. The sequence or arrangement of the systems 12, 14, 16, 18 relative to one another and relative to the card input 20 can be varied from the sequence that is illustrated in FIG. 1.

The system 10 may include additional card processing systems not illustrated in FIG. 1, which are well known in the art of card processing and which may also be located between the card input 20 and the card output 22. For example, the system 10 may include a card embossing system that is configured to emboss characters on the cards; an indenting system that is configured to indent characters on the cards; a laminator system that is configured to apply a laminate to the cards; a laser system that uses a laser to perform laser processing such as laser marking on the cards; a topcoat station that is configured to apply a topcoat to a portion of or the entire surface of the cards; a quality control station that is configured to check the quality of personalization/processing applied to the cards; a security station that is configured to apply a security feature such as a holographic foil patch to the cards; and other card processing operations. The additional card processing systems may be located anywhere in the system 10, such as between the UV cure station 18 and the card output 22.

Non-limiting examples of the DOD card printing system 12 are illustrated in FIGS. 2-6. Other examples are possible. The general construction and operation of DOD card printing systems is well-known in the art. One example of a conventional DOD card printing system is found in the Persomaster card personalization system available from Atlantic Zeiser GmbH of Emmingen, Germany.

Each of the DOD card printing systems 12 in FIGS. 2-5 includes at least one DOD print head 30, an ink delivery system 32 connected to the DOD print head 30, and a vacuum system 34 for applying a vacuum to the DOD print head 30. In addition, each system 12 can include a cap tray 36 that is selectively positionable underneath the DOD print head(s) 30 and that is configured to be movable between a covering position directly under the DOD print head(s) 30 and a non-covering position during printing operations. The cap tray 36 is also configured to collect ink that may be discharged from the DOD print head(s) 30 when the cap tray 36 is in the covering position.

The printing performed by the DOD card printing system 12 can be monochromatic using a single or multi-color using two or more colors. If multiple print heads are used, the print heads are arranged generally side-by-side to sequentially print onto a surface of a card as the card is transported past the print heads, for example underneath the print heads. The DOD print head(s) 30 can print using any suitable ink or coating (such as a varnish) used in DOD printing and that is suitable for use on the types of plastic cards described herein. For example, the ink can be a UV curable ink, a heat curable ink that can be cured by applying heat to the heat curable ink, or other ink or other materials that can be deposited by a DOD print head. An example of a DOD printer that prints using UV curable ink in a card printing system is the Persomaster card personalization system available from Atlantic Zeiser GmbH of Emmingen, Germany. Each DOD print head 30 can print a specific color ink.

In general, each DOD print head 30 includes a bottom surface that faces downward toward the plastic card to be printed on. A nozzle plate, through which ink is ejected, is provided on a portion of the bottom surface. The nozzle plate includes a plurality of openings therein, each opening being associated with a nozzle of the print head from which ink is ejected. Each DOD print head 30 can be a piezo-electric print head which requires electrical energy to energize the print head and dispense ink. The general mechanical construction and operation of piezo-electric print heads is well-known in the art.

Figure 2:
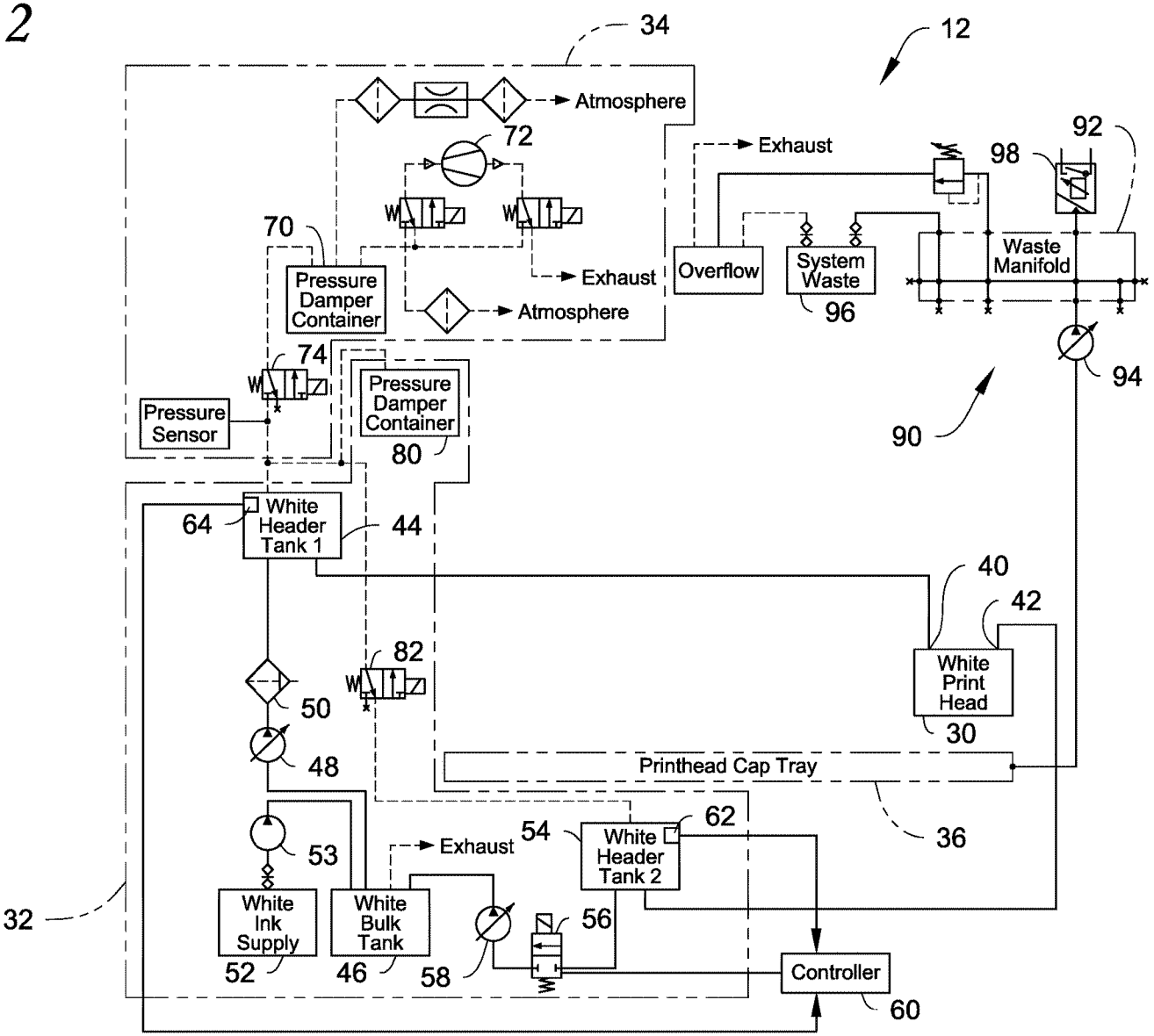
FIG. 2 illustrates an embodiment of a DOD card printing system described herein that can be used with the card processing system.

Referring to FIG. 2, a first embodiment of the DOD card printing system 12 will be described. In the embodiment of FIG. 2, the system 12 includes a single print head 30. The system 12 is also provided with a recirculation system as part of the ink delivery system 32 that provides recirculation of the ink (or other material) to be ejected from the print head 30. To help in describing the concepts illustrated in the system 12 in FIG. 2, the material discharged by the single print head 30 will be described and illustrated as being white ink. As described above, white ink contains particulate material therein, so the white ink is recirculated to help keep the particulate material adequately dispersed in the white ink. However, the material discharged by the print head 30 is not limited to white ink and can be any material where it is beneficial to recirculate the material including, but not limited to, spot colors such as metallic (e.g. gold, silver, etc.) inks, and ink that is recirculated in order to remove gas from the ink.

The print head 30 includes an inlet 40 connected to a supply side of the ink delivery system 32 and an outlet 42 connected to a recirculation side of the ink delivery system 32. The outlet 42 is distinct from the discharge nozzles from which ink is discharged during a printing operation and which are typically located at the bottom of the print head 30. On the supply side, the inlet 40 is fluidly connected to a first header tank 44 which contains an amount of the white ink and provides a constant supply of white ink to the print head 30. The supply side further includes a bulk tank 46 containing a bulk supply of the white ink, a supply pump 48 that pumps the white ink from the bulk tank 46 to the header tank 44, a filter 50 between the supply pump 48 and the header tank 44 that filters the white ink, a white ink supply 52, and a pump 53 that pumps white ink from the supply 52 to the bulk tank 46 as needed. The supply pump 48 is depicted as being a variable displacement pump. However, the supply pump 48 can have any construction that is suitable to allow the pump to perform the functions of the supply pump 48.

With continued reference to FIG. 2, on the recirculation side, the outlet 42 is fluidly connected to a second header tank 54 which also contains an amount of the white ink. The second header tank 54 is fluidly connected to the bulk tank 46 via a suitable flow line. A valve 56 (which can also be referred to as a recirculation valve) is disposed in the flow line controlling the flow from the second header tank 54 to the bulk tank 46. In addition, a return pump 58 (which can also be referred to as a recirculation pump) is also disposed in the flow line, such as between the valve 56 and the return tank 46. The return pump 58 is illustrated as being a variable displacement pump. However, the return pump 58 can have any construction that is suitable to allow the pump to perform the functions of the return pump 58.

A controller 60 is provided that is connected to the valve 56 (which can be, for example, a solenoid valve) to control the operation of the valve 56. The controller 60 (or a separate controller) can also be connected to the other valves described herein. The controller 60 (or a separate controller) can also be connected to the pumps described herein to control the operation of the pumps. The controller 60 can be separate from, or the same as, the controller 24 in FIG. 1.

An ink level sensor 62, such as a float sensor, can be provided in the header tank 54 for sensing the level of the ink in the header tank 54, with the sensor 62 providing ink level readings to the controller 60. In addition, an ink level sensor 64, such as a float sensor, can be provided in the header tank 44 for sensing the level of the ink in the header tank 44, with the sensor 64 providing ink level readings to the controller 60. In operation, one or more of the ink level readings in the header tanks 44, 54 can be used to determine when to recirculate ink. For example, the ink level readings from the ink level sensor 62 in the header tank 54 can be used to control the valve 56 and the operation of the pumps 48, 58 to determine when recirculation occurs.

Alternatively, both of the ink level sensors 62, 64 can be used to control the valve 56 and the operation of the pumps 48, 58 to determine when recirculation occurs. In such an embodiment, to recirculate, both of the ink level sensors 62, 64 must indicate that the respective header tanks 54, 44 are full for a predetermined period of time, referred to as a timeout, which results in the valve 56 being opened and short bursts of operation of the return pump 58 during the timeout. When one or both of the ink level sensors 62, 64 clears (i.e. determines that the ink level in the respective header tank 54, 44 has reduced below a certain level), the valve 56 is closed and the header tank(s) 44, 54 can then be refilled. Otherwise, the valve 56 is left open during the timeout to permit gravity flow of ink back to the bulk tank 46.

In a conventional DOD printing system, the header tank 44 and the supply pump 48 are connected to the inlet 40 of the print head 30 to supply ink from the bulk tank 46, and the header tank 54 and the return pump 58 are connected to the outlet 42 of the print head 30 to return ink to the bulk tank 46. In the conventional system, the ink flows by gravity from the header tank 44 to the header tank 54, while ink flows from the header tank 54 back to the bulk tank 46 via gravity and/or is pumped back using a pump. The DOD card printing system 12 differs from the conventional DOD printing system by providing the valve 56 between the header tank 54 and the bulk tank 46. When the valve 56 is closed, the valve 56 controls the flow of ink from the header tank 54 to the bulk tank 46. This permits tightly controlled recirculation and control of the level of the ink in the header tank 54, and provides a much more tolerant height adjustment for the header tank 54 so that, for example, both of the header tanks 44, 54 can be at the same height.

Instead of or in addition to relying on the sensor(s) 62, 64 to control recirculation, the recirculation can be frequency controlled, for example by the controller 24. A predetermined recirculation frequency can be set which determines how frequently recirculation occurs after a prior recirculation. In one embodiment, the frequency can be set in code programmed into the controller. In another embodiment, the frequency can be user settable. In one embodiment, the recirculation frequency can be every about 1.0 to about 60.0 seconds. In another embodiment, the recirculation frequency can be every about 1.0 to about 15.0 seconds. In another embodiment, the recirculation frequency can be about 4.0 seconds.

Still referring to FIG. 2, the vacuum system 34 is conventional in construction and need not be described in detail. The vacuum system 34 is configured to apply the vacuum to the nozzles of the print head 30 to establish the desired meniscus on the ink in the nozzles. The vacuum system 34 includes a pressure dampening container 70 (or pressure damper container) connected to a vacuum pump 72 and an isolation valve 74 which can be, for example, a solenoid valve. The dampening container 70 has a slow leak to it to enable excess vacuum to dissipate. The isolation valve 74 provides the ability to isolate the ink delivery system 32 from the vacuum system 34, and helps to maintain vacuum in the event of a power loss. However, in a recirculating ink delivery system, such as the system 32, it is desirable to always have a sufficient amount of dampening (regardless of the state of the isolation valve 74) due to the fact that adding and subtracting ink can cause significant pressure variations. This causes an issue when the isolation valve 74 is closed and the recirculation of the ink continues. Since there is no damping (due to the isolation valve 74 being closed which isolates the dampening container 70 from the ink delivery system 32), the supply pump 48 and the return pump 58 cause large and abrupt spikes in pressure, which disturb the meniscus in the nozzles and cause poor resulting print quality.

Therefore, as illustrated in FIG. 2, a second dampening volume 80 (or second pressure damper container) is provided in the ink delivery system 32 downstream of the isolation valve 74. For example, the second dampening volume 80 can be fluidly connected to the header tank 44, for example to a fluid line between the header tank 44 and the isolation valve 74. In addition, the second dampening volume 80 is fluidly connected to the header tank 54 via a fluid line, and a valve 82, such as a solenoid valve, is provided in the flow line controlling flow therethrough. The second dampening volume 80 is sealed without a slow leak in order to preserve the ability of the second dampening volume 80 to maintain vacuum in a power loss.

In the configuration of FIG. 2, the DOD card printing system 12 sees both the first dampening volume 70 and the second dampening volume 80 under normal operating conditions with the isolation valve 74 opened. However, upon a power loss or otherwise when the isolation valve 74 is closed, the DOD card printing system 12 only sees the second dampening volume 80, with the second dampening volume 80 maintaining the vacuum acting on the print head 30. The second dampening volume 80 is sized to allow recirculation of the ink to occur without disturbing the meniscus. The state (i.e. open or closed) of the valves 82 and 74 are generally the same. One exception is when filling the header tank 44, the valve 74 is open with slight positive pressure that the pump 48 can overcome, and the valve 82 is closed. Once the header tank 44 is full, the valve 82 is opened and follows the state of the valve 74. When power is lost, the valve 74 is closed and the valve 82 is opened to maintain vacuum. In one embodiment, the only time the valve 82 ever closes (always open otherwise) is during the autofill and autodrain procedures described herein.

A waste collection system 90 is connected to the cap tray 36 to collect ink that may be discharged into the cap tray 36. The waste collection system 90 includes a waste manifold 92 that is fluidly connected to the cap tray via a fluid line, and a waste pump 94 is provided in the fluid line that pumps waste ink from the cap tray 36 into the manifold 92. In addition, the waste collection system 90 can include a waste collection container 96 into which waste ink from the waste manifold 92 can be collected. The waste collection container 96 can be connected to the system using a quick connect fitting to simplify installation and removal of the container 96. However, one consequence of this type of connection is if the user fails to install the container 96 into the quick connect fitting, there is potential to build pressure. To address this, a pressure switch 98 is provided which detects a build-up of pressure resulting from forgetting to connect the waste collection container 96, where the pressure switch 98 will send a signal to the controller once a certain pressure is reached to warn the user of the pressure increase and/or to warn the user to install the waste collection container 96.

Figure 3:
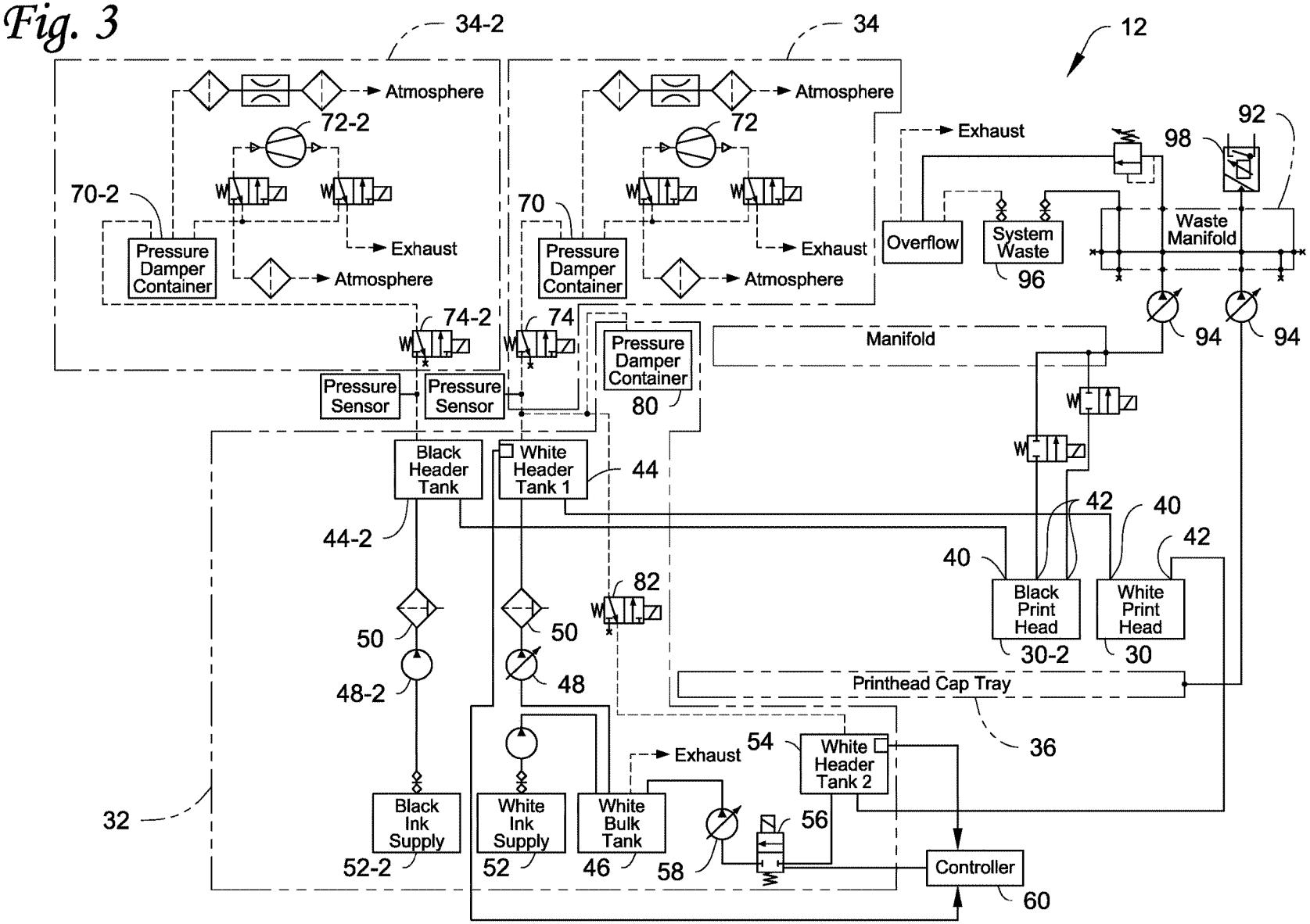
FIG. 3 illustrates another embodiment of a DOD card printing system described herein that can be used with the card processing system.

FIG. 3 illustrates another embodiment of the DOD card printing system 12 that is similar to the DOD card printing system 12 in FIG. 2, and like elements are referenced using the same reference numbers increased by "−2". The system 12 in FIG. 3 includes two print heads, including the first print head 30 and a second print head 30-2. The print head 30 and the components connected thereto are identical in construction, function and operation to those described in FIG. 2. However, the system 12 in FIG. 3 includes the second print head 30-2 which is supplied with a second ink, different from the ink supplied to the print head 30, for printing a different color. To help in describing the concepts illustrated in the system 12 in FIG. 3, the second ink supplied to and discharged by the second print head 30-2 will be described and illustrated as being black ink. However, the second ink supplied to and discharged by the second print head 30-2 can be any color ink, including Cyan, Magenta and Yellow, that does not require recirculation of the ink.

The print head 30-2 includes an inlet 40 connected to a supply side of the ink delivery system 32 and a pair of outlets 42, 42. The outlets 42 are distinct from the discharge nozzles from which ink is discharged during a printing operation and which are typically located at the bottom of the print head 30-2. On the supply side, the inlet 40 is fluidly connected to a header tank 44-2 which contains an amount of the black ink and provides a constant supply of black ink to the print head 30-2. The supply side further includes a black ink supply 52-2, and a supply pump 48-2 that pumps black ink from the supply 52-2 to the header tank 44-2 as needed through the filter 50. In addition, a second vacuum system 34-2 is connected to the header tank 44-2 and includes a pressure dampening container 70-2 (or pressure damper container) connected to a vacuum pump 72-2 and an isolation valve 74-2 which can be, for example, a solenoid valve. The outlets 42 of the print head 30-2 are fluidly connected to the waste manifold 92 via the waste pump 94.

Figure 4:
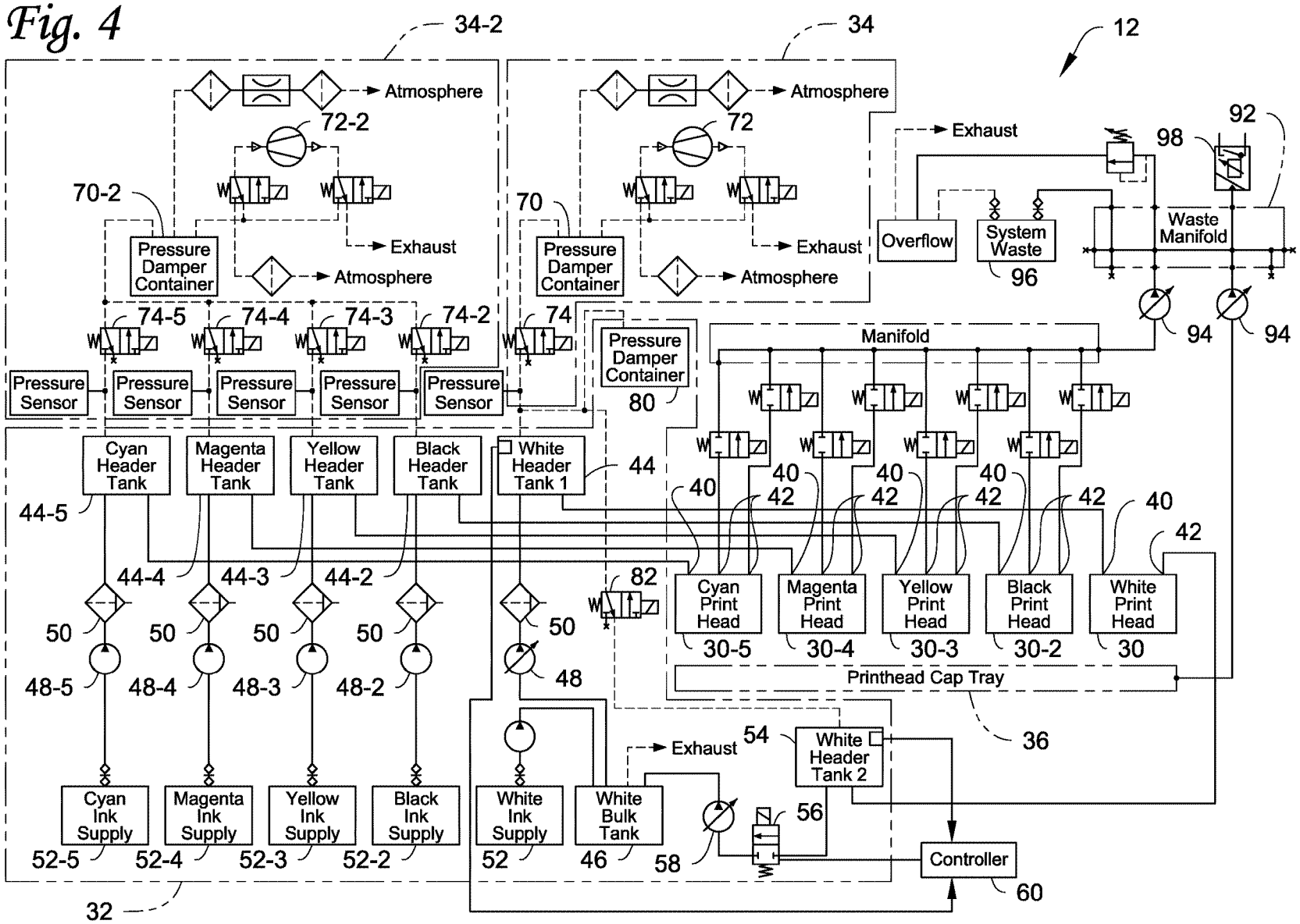
FIG. 4 illustrates still another embodiment of a DOD card printing system described herein that can be used with the card processing system.

Any number of additional ink colors or materials can be added into the system 12. For example, FIG. 4 illustrates another embodiment of the DOD card printing system 12 that is similar to the DOD card printing system 12 in FIG. 3, and like elements are referenced using the same reference numbers increased by "−2", "−3", "−4", or "−5". The system 12 in FIG. 4 includes five print heads, including the first print head 30, the second print head 30-2, a third print head 30-3, a fourth print head 30-4, and a fifth print head 30-5. The print heads 30, 30-2 and the components connected thereto are identical in construction, function and operation to those described in FIGS. 2 and 3. However, the system 12 now adds the additional print heads 30-3, 30-4, 30-5 each of which is supplied with its own ink, different from the inks supplied to the print heads 30, 30-2. For example, the print head 30-3 can be supplied with Yellow colored ink, the print head 30-4 can be supplied with Magenta colored ink, and the print head 30-5 can be supplied with Cyan colored ink. Like the black ink supplied to the print head 30-2, the ink supplied to the print heads 30-3, 30-4 and 30-5 are preferably inks or other materials that do not require recirculation.

The print heads 30-3, -4, -5 are similar to the print head 30-2 but each prints a different color. Each of the print heads 30-3, 30-4, 30-5 includes an inlet 40 connected to a supply side of the ink delivery system 32 and a pair of outlets 42. The outlets 42 are distinct from the discharge nozzles from which ink is discharged during a printing operation and which are typically located at the bottom of the respective print head. On the supply side, the inlet 40 is fluidly connected to a header tank 44-3, -4, -5 for the respective color which contains an amount of the respective ink and provides a constant supply of ink to the respective print head 30-3, -4, -5. The supply side further includes a respective ink supply 52-3, -4, -5, and a supply pump 48-3, -4, -5 that pumps ink from the supply 52-3, -4, -5 to the header tank 44-3, -4, -5 as needed, through a filter 50. In addition, the second vacuum system 34-2 is connected to each of the header tanks 44-2, -3, -4, -5 and includes the pressure dampening container 70-2 (or pressure damper container) connected to the vacuum pump 72-2 and an isolation valve 74-2, -3, -4, -5 which can be, for example, a solenoid valve is provided for each header tank 44-2, -3, -4, -5. The outlets 42 of the print head 30-2, -3, -4, -5 are fluidly connected to the waste manifold 92 via the waste pump 94.

Figure 5:
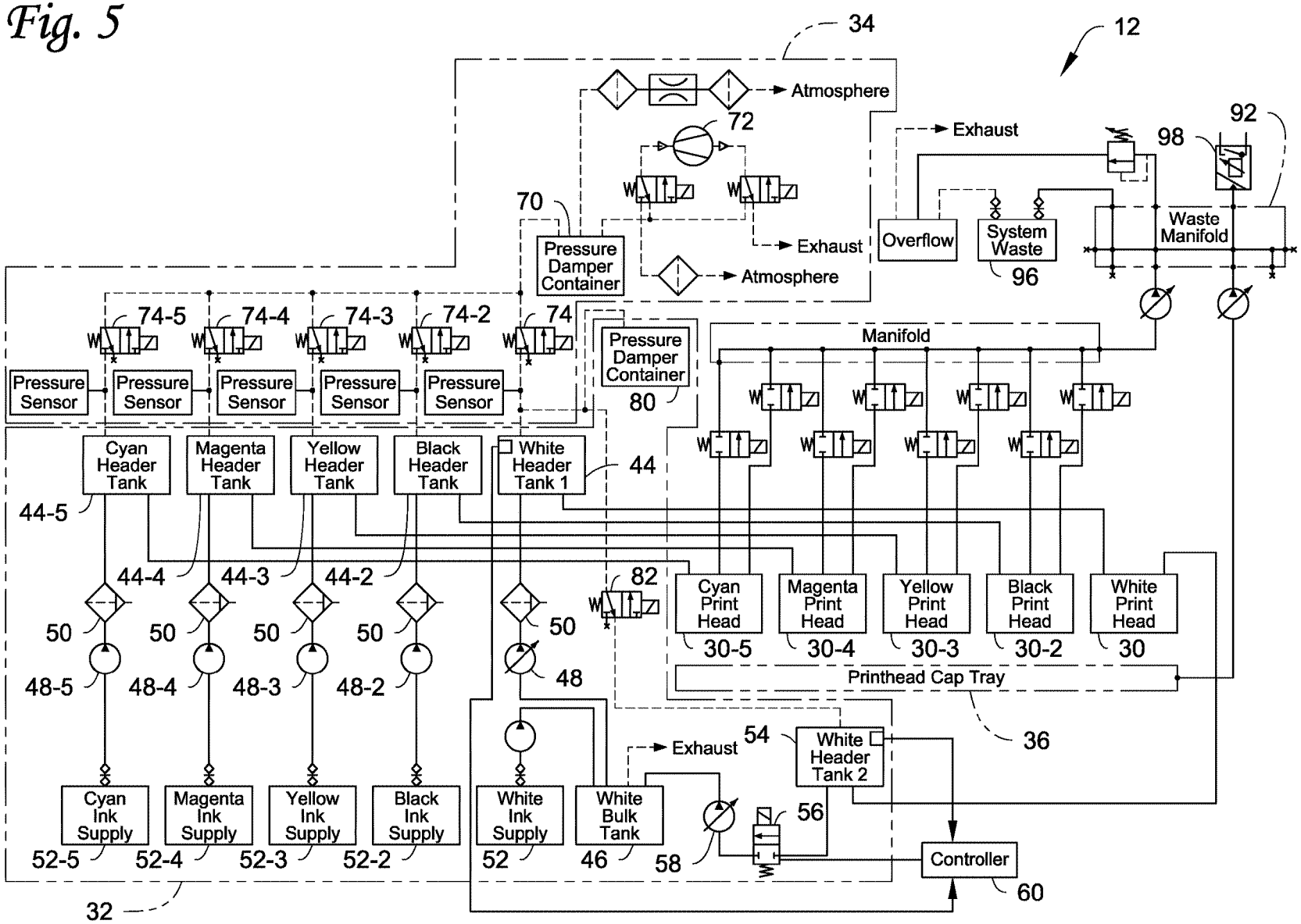
FIG. 5 illustrates still another embodiment of a DOD card printing system described herein that can be used with the card processing system.

FIG. 5 illustrates a system 12 that is similar to the system 12 in FIG. 4 except that the single vacuum system 34 is connected to all of the header tanks 44, 44-2, -3, -4, -5 to apply vacuum to each of the print heads 30, 30-2, -3, -4, -5, instead of using the second vacuum system 34-2. The system 12 in FIG. 3 could also use the single vacuum system 34 instead of the separate vacuum systems 34, 34-2.

Figure 6:
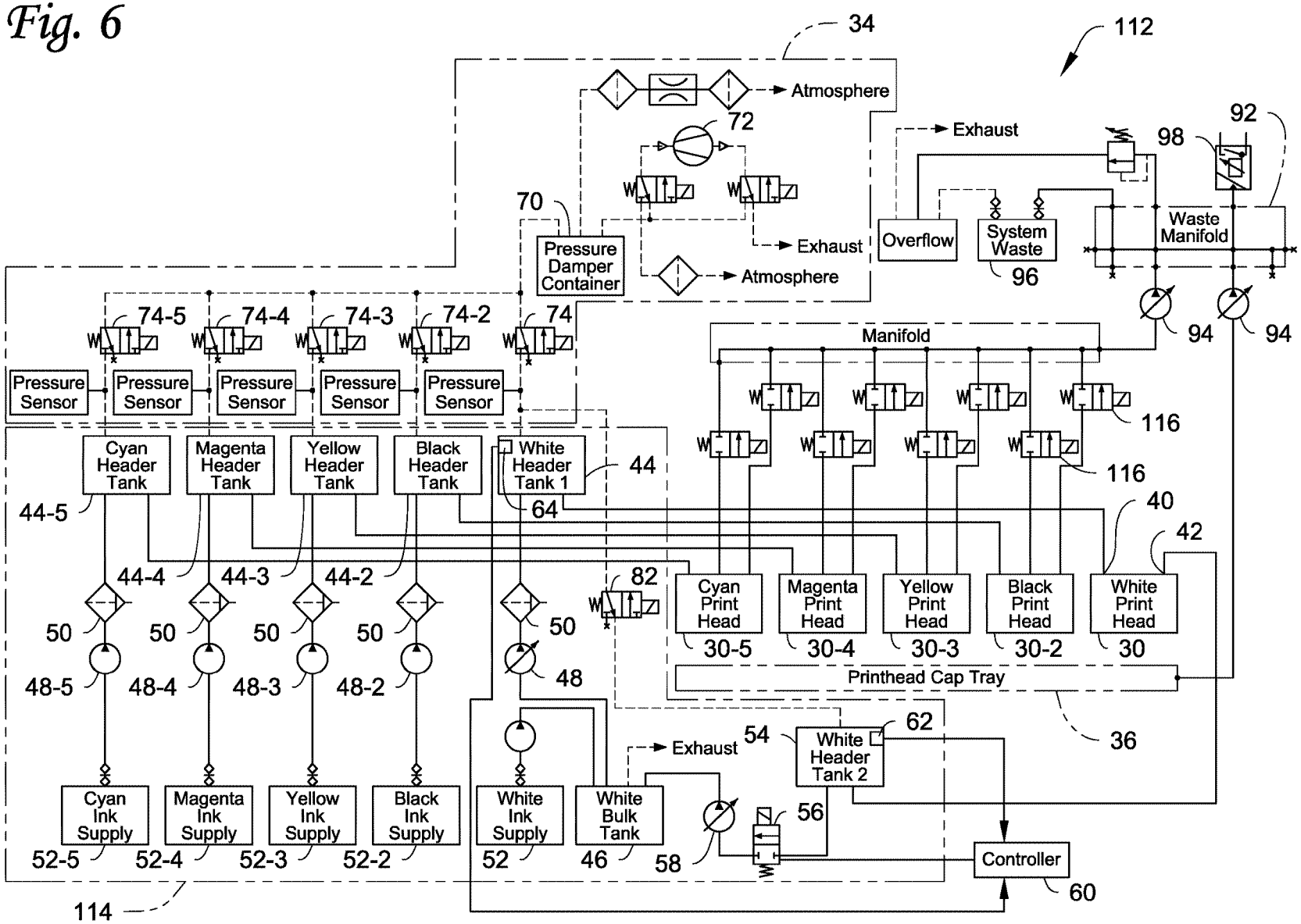
FIG. 6 illustrates still another embodiment of a DOD card printing system described herein that can be used with the card processing system.

Referring to FIG. 6, an embodiment of a DOD card printing system 112 that is configured to perform an autofill/autodrain procedure on an ink delivery system 114 is illustrated. The system 112 is generally similar in construction and certain functions to the systems 12 in FIGS. 2-5 and like elements are referenced using the same reference numbers. The system 112 is illustrated as being identical to the system 12 in FIG. 5 except that the second dampening volume 80 used in the system 12 in FIG. 5 is not used in the system 112 in FIG. 6. Alternatively, the system 112 can be identical to the system 12 in FIG. 4 with the separate vacuum systems 34, 34-2 except with the second dampening volume 80 that is used in the system 12 in FIG. 5 not used in the system 112 in FIG. 6. Alternatively, the autofill/autodrain procedures described herein could be used with any of the systems 12 in FIGS. 2-5 that include the second dampening volume 80.

In a conventional DOD printing system, when pumping air through a wet ink filter in the system, a significant amount of ink foam is generated. For example, after the ink delivery system has had its initial supply of ink used up, the filters become wetted. When filling an empty (but wet) ink delivery system, the residual air must be displaced by ink from the ink supply. The displacement of air through the wetted filter generates the foam. The ink foam is not dense enough to raise the ink level sensors 64, which are monitored to determine when the header tanks 44, 44-2, -3, -4, -5 are full and turn off the supply pumps 48. Since the ink level sensors 64 fail to rise, the supply pumps 48 continue to pump and the foam subsequently overflows the header tanks 44, 44-2, -3, -4, -5 into the vacuum system 34 contaminating the vacuum system 34. In addition, when draining the ink delivery system 114, the print heads 30, 30-2, -3, -4, -5 contain an internal filter, which, when pumping the ink delivery system 114 (i.e. displacing ink with air) generates more foam. This foam comes out through the print head nozzles and creates foam contamination underneath the nozzles, requiring a certain amount of manual cleanup and can contaminate neighboring print heads.

The system 112 in FIG. 6 avoids these problems by suitably controlling the supply pump 48 which pumps ink to the inlet of the print head, and simultaneously controlling the return pump 58 to take ink out of the outlet of the print head. When doing a system fill or drain, the supply pump connected to the inlet of the print head is run so that it has a lower flow rate than the pump connected to the outlet of the print head. The differential in flow rates is made up by air flowing in through the print head nozzles. In one non-limiting example, the pumps 48, 58 are operated simultaneously with the flow rate of the pump 58 being about 2 times greater than the flow rate of the pump 48.

For example, when doing a system fill or drain of the white ink, the supply pump 48 connected to the inlet 40 of the print head 30 is run so that it has a lower flow rate than the return pump 58 connected to the outlet 42 of the print head 30, and the differential in flow rates is made up by a net flow of air flowing in through the nozzles of the print head 30. In addition, the vacuum system 34 must be sealed which is achieved by closing the isolation valve 74. In addition, the valve 82 is closed and the valve 56 is opened. During a filling operation of the white ink, since the return pump 58 is fluidly connected to the bulk tank 46, any parasitic foam that is generated is continuously pumped to the bulk tank 46 until all of the air has been removed from the system at which point it is safe to pump white ink as required during normal operation. When draining the white ink, air is being supplied to displace the white ink. The generation of foam underneath the print head 30 is avoided since there is a net flow of air into the print head 30 through the nozzles, and the foam is again pumped into the bulk tank 46.

When doing a system fill or drain of any of the other colors of the ink, such as CMY or K, the respective supply pump 48-2, -3, -4, -5 connected to the inlet 40 of the print head 30-2, -3, -4, -5 is run so that it has a lower flow rate than the waste pump 94 (which acts as a return pump) connected to the outlets 42 of the respective print head 30-2, -3, -4, -5, and the differential in flow rates is made up by a net flow of air flowing in through the nozzles of the respective print head 30-2, -3, -4, -5. In addition, the vacuum system 34 must be sealed which is achieved by closing the respective isolation valve 74-2, -3, -4, -5 for the color being filled/drained. In addition, one or both valves 116 connected to the outlets 42 of the print heads 30-2, -3, -4, -5 and leading to the waste manifold 92 must be opened. During a filling operation of one of the CMYK inks, since the waste pump 94 is fluidly connected to the waste manifold 92, any parasitic foam that is generated is continuously pumped to the waste manifold 92 until all of the air has been removed from the system at which point it is safe to pump the particular CMYK ink as required during normal operation. When draining the CMYK ink, air is being supplied to displace the particular CMYK ink. The generation of foam underneath the print head 30-2, -3, -4, -5 is avoided since there is a net flow of air into the print head through the nozzles, and the foam is again pumped into the waste manifold 92.

The recirculation with the valve 56 and the use of the second dampening volume 80 can be implemented together as illustrated in FIGS. 2-5 or they can be implemented individually and separately from one another. In addition, the recirculation with the valve 56, the use of the second dampening volume 80, and the system fill or drain can be implemented individually and separately from one another or implemented in any combination thereof.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A plastic card processing system, comprising:

a drop-on-demand plastic card printing system that includes:

a drop-on-demand print head having an ink inlet and an ink outlet;

an ink delivery system connected to the drop-on-demand print head, the ink delivery system includes:

a first ink header tank fluidly connected to the ink inlet and a second ink header tank fluidly connected to the ink outlet;

an ink supply tank containing a supply of ink;

a supply pump fluidly connected between the ink supply tank and the first ink header tank;

a return pump fluidly connected between the second ink header tank and the ink supply tank; and a first valve fluidly connected between the second ink header tank and the ink supply tank to control flow from the second ink header tank to the ink supply tank;

a vacuum system fluidly connected to the first ink header tank that applies a vacuum to the drop-on-demand print head; and at least one of the following:

a magnetic stripe read/write system that is configured to read data and/or write data to a magnetic stripe on a plastic card that is input into the plastic card processing system;

a chip programming system that is configured to program an integrated circuit chip on a plastic card that is input into the plastic card processing system.

2. The plastic card processing system of claim 1, wherein the first valve is fluidly connected between the return pump and the second ink header tank.

3. The plastic card processing system of claim 1, wherein the ink comprises an ink with a particulate material in the ink.

4. The plastic card processing system of claim 1, wherein the ink comprises a white ink or a metallic ink.

5. The plastic card processing system of claim 1, further comprising a flow path fluidly interconnecting the vacuum system with the second ink header tank, and a second valve disposed in the flow path and controlling flow therethrough.

6. The plastic card processing system of claim 5, further comprising a first sealed pressure damper container in the flow path and fluidly connected to the vacuum system between the second valve and the vacuum system.

7. The plastic card processing system of claim 6, wherein the vacuum system includes a second pressure damper container and an isolation valve between the second pressure damper container and the first ink header tank, and the flow path fluidly connects to a flow path between the isolation valve and the first ink header tank.

8. A drop-on-demand plastic card printing system, comprising:

a drop-on-demand print head having an ink inlet and an ink outlet;

an ink delivery system connected to the drop-on-demand print head, the ink delivery system includes:

a first ink header tank fluidly connected to the ink inlet and a second ink header tank fluidly connected to the ink outlet;

an ink supply tank containing a supply of ink;

a supply pump fluidly connected between the ink supply tank and the first ink header tank;

a return pump fluidly connected between the second ink header tank and the ink supply tank; and a first valve fluidly connected between the second ink header tank and the ink supply tank to control flow from the second ink header tank to the ink supply tank;

a vacuum system fluidly connected to the first ink header tank that applies a vacuum to the drop-on-demand print head;

wherein the supply pump and the return pump are simultaneously operable at different flor rates from one another.

9. The plastic card processing system of claim 1, further comprising:

a card input that is configured to hold a plurality of plastic cards to be printed on;

a card output that is configured to hold a plurality of plastic cards that have been processed; and the drop-on-demand plastic card printing system is located downstream from the card input and receives plastic cards that are input from the card input.

10. A plastic card processing system, comprising:

a drop-on-demand plastic card printing system that includes:

a drop-on-demand print head having an ink inlet and an ink outlet;

an ink delivery system connected to the drop-on-demand print head, the ink delivery system includes:

a first ink header tank fluidly connected to the ink inlet and a second ink header tank fluidly connected to the ink outlet;

an ink supply tank containing a supply of ink;

a return pump fluidly connected between the second ink header tank and the ink supply tank; and a first valve fluidly connected between the second ink header tank and the ink supply tank to control flow from the second ink header tank to the ink supply tank;

a vacuum system fluidly connected to the first ink header tank that applies a vacuum to the drop-on-demand print head; and a valve controller electrically connected to the first valve; and a first ink level sensor in the second ink header tank, the first ink level sensor is electrically connected to the valve controller and sends signals to the valve controller to control the first valve; and at least one of the following:

a magnetic stripe read/write system that is configured to read data from and/or write data to a magnetic stripe on a plastic card that is input into the plastic card processing system;

a chip programming system that is configured to program an integrated circuit chip on a plastic card that is input into the plastic card processing system.

11. The plastic card processing system of claim 10, further comprising a second ink level sensor in the first ink header tank, the second ink level sensor is electrically connected to the valve controller.

12. A drop-on-demand plastic card printing system, comprising:

a drop-on-demand print head having an ink inlet and an ink outlet;

an ink delivery system connected to the drop-on-demand print head, the ink delivery system includes:

an ink header tank fluidly connected to the ink inlet an ink collection tank fluidly connected to the ink outlet;

an ink supply tank containing a supply of ink;

a supply pump fluidly connected between the ink supply tank and the ink header tank;

an outlet pump fluidly connected to the ink outlet;

a vacuum system fluidly connected to the drop-on-demand print head that applies a vacuum to the drop-on-demand print head, the vacuum system includes a pressure damper container and an isolation valve between the pressure damper container and the ink header tank;

wherein during filling the drop-on-demand plastic card printing system with ink or draining ink from the drop-on-demand plastic card printing system, the supply pump and the outlet pump are simultaneously operable at different flow rates from one another.

13. A plastic card processing system, comprising:

a card input that is configured to hold a plurality of plastic cards to be printed on; and the drop-on-demand plastic card printing system of claim 12 downstream from the card input and receiving plastic cards that are input from the card input.

14. A method of operating a drop-on-demand plastic card printing system of a plastic card processing system, the drop-on-demand plastic card printing system including a supply pump connected to an ink inlet of a drop-on-demand print head and an outlet pump connected to an ink outlet of the drop-on-demand print head, the method comprising:

conducting a system ink fill to fill the system with ink or a system ink drain to drain ink from the system;

wherein conducting the system ink fill or the system ink drain includes sealing a vacuum system from the drop-on-demand print head, and simultaneously operating the supply pump and the outlet pump so that a flow rate of the supply pump is different than a flow rate of the outlet pump.

15. The method of claim 14, comprising conducting a system ink fill, and operating the supply pump so that the flow rate thereof is less than the flow rate of the outlet pump.

16. The method of claim 14, comprising conducting a system ink drain, and operating the supply pump so that the flow rate thereof is less than the flow rate of the outlet pump.

17. A plastic card processing system, comprising:

a drop-on-demand plastic card printing system that includes:

a first drop-on-demand print head having an ink inlet and an ink outlet;

a second drop-on-demand print head having an ink inlet and an ink outlet;

an ink delivery system connected to the first drop-on-demand print head and to the second drop-on-demand print head, the ink delivery system includes:

a first ink header tank fluidly connected to the ink inlet of the first drop-on-demand print head;

a second ink header tank fluidly connected to the ink inlet of the second drop-on-demand print head;

a first ink supply tank containing a supply of ink, the first ink supply tank is fluidly connected to the first ink header tank;

a second ink supply tank containing a supply of ink, the second ink supply tank is fluidly connected to the second ink header tank;

a first vacuum system fluidly connected to the first ink header tank that applies a vacuum to the first drop-on-demand print head; and a second vacuum system fluidly connected to the second ink header tank that applies a vacuum to the second drop-on-demand print head; and at least one of the following:

a magnetic stripe read/write system that is configured to read data from and/or write data to a magnetic stripe on a plastic card that is input into the plastic card processing system;

a chip programming system that is configured to program an integrated circuit chip on a plastic card that is input into the plastic card processing system.

* * * * *